US005316531A

United States Patent [19]

Spence

[11] Patent Number: 5,316,531

[45] Date of Patent: May 31, 1994

[54] HAND HELD WEIGHTED DEVICES FOR AEROBIC EXERCISE

[75] Inventor: Wayman R. Spence, Waco, Tex.

[73] Assignee: WRS Group, Inc., Waco, Tex.

[21] Appl. No.: 892,786

[22] Filed: Jun. 3, 1992

[51] Int. Cl.[5] ..... A63B 21/06

[52] U.S. Cl. ..... 482/93; 482/74; 482/106

[58] Field of Search ..... 482/44-50, 482/93, 106, 108, 109, 110, 132, 148, 74

[56] References Cited

U.S. PATENT DOCUMENTS

| | | | |
|---|---|---|---|
| 3,171,652 | 3/1965 | Newman | 482/106 |
| 3,781,007 | 12/1973 | Baker et al. | 482/106 X |
| 3,820,781 | 6/1974 | Kane | 482/93 |
| 3,874,660 | 4/1975 | Brethen . | |
| 4,218,057 | 8/1980 | Wilson | 482/93 |
| 4,278,248 | 7/1981 | Kifferstein | 482/93 X |
| 4,345,750 | 8/1982 | Lo Voi | 482/132 |
| 4,440,391 | 4/1984 | Saenz, Jr. et al. | 482/148 X |
| 4,480,828 | 11/1984 | Kifferstein | 482/93 X |
| 4,513,963 | 4/1985 | Nelson et al. | 482/93 X |
| 4,634,121 | 1/1987 | Sasaki . | |
| 4,664,373 | 5/1987 | Hait | 482/93 |
| 4,688,788 | 8/1987 | Olufs . | |
| 4,722,523 | 2/1988 | Yang | 482/93 X |
| 4,743,016 | 5/1988 | Van Derworp et al. | 482/93 |
| 4,819,935 | 4/1989 | Dirksing et al. . | |
| 4,878,673 | 11/1989 | Pollard . | |
| 4,929,211 | 5/1990 | Resnick et al. | 482/49 X |

*Primary Examiner*—Robert Bahr
*Attorney, Agent, or Firm*—Baker & Botts

[57] ABSTRACT

A hand held weighted exercise device 10 includes an elongated, rigid tube 11 having a hollow interior 40. A weighted mass is mounted in a portion of the hollow interior 40 of tube 11. Tube 11 is covered with a resilient coverpiece 20, such as foam rubber, which is preferably divided into at least three distinct sections 22, 24 and 26. Sections 22, 24 and 26, each consisting of a different color, define grasping positions to provide a selected effective weight to be lifted.

12 Claims, 2 Drawing Sheets

HAND HELD WEIGHTED DEVICES FOR AEROBIC EXERCISE

TECHNICAL FIELD OF THE INVENTION

The present invention relates to weighted devices for use in exercise and, more particularly, to hand held weighted devices used to enhance the benefits of aerobic exercise.

BACKGROUND OF THE INVENTION

Recent studies show significant advantages of strenuous concurrent exercise of the arms and legs over strenuous exercise of the legs alone. See Mostardi, Gandee and Norris, *Archives of Physical Medicine Rehabilitation*, pp. 332–336, July 1981. When strenuous arm work is used in combination with strenuous leg work, there is better progress in reducing arterial blood pressure, increasing the level of conditioning and improving the overall feeling of well being.

In the prior art, the use of weighted devices has been found to enhance the benefits of aerobic exercise; however, the hand held weights of the prior art, e.g., balanced dumb bells, have problems and shortcomings which make them less than satisfactory in providing optimal arm and upper body work during exercise. These conventional hand held weights are held in the hands of the user, by their sides, while walking or doing other aerobic exercise. Accordingly, these weights are merely carried, thereby providing less than optimal arm and upper body exercise.

U.S. Pat. No. 3,874,660, issued to Brethen, discloses a device for use in isometric exercises having a handle and a plurality of weights at one end, some of which are detachable. The handle may be grasped at different positions for varying the effective torque of the weight relative to the user's hand. The Brethen device is intended for use in isometric exercise rather than aerobic exercise, such as walking, riding a stationary bicycle or running. Although Brethen states (Col. 2, lines 60–64) that the device may be used while walking, Brethen makes no mention of the effect of the user's grasping position on the handle on his stride length, cardiovascular load or calorie consumption.

U.S. Pat. No. 4,878,673, issued to Pollard, discloses a golf swing training device comprising a pair of variable length shafts, each with a weight attached by a short, flexible cable. The Pollard patent makes no mention of the effect of using the golf swing training device in accordance with aerobic exercise.

U.S. Pat. No. 4,687,788, issued to Olufs, discloses a pair of cane-like poles having a weight at the handle ends. The Olufs patent makes no mention of the effect of the user's grasping position at various places along the cane to affect a user's stride length, cardiovascular load or calorie consumption. Further, the Olufs patent does not suggest a method for swinging the weights to increase stride length.

It has therefore become desirable to devise hand held weights for use in aerobic exercise that may be grasped at a variety of positions to affect a user's stride length, cardiovascular load or calorie consumption. Accordingly, the weights may be repetitively swung or lifted, and not just carried.

SUMMARY OF THE INVENTION

According to the invention, a hand held weighted device is provided, which yields progressive strengthening and enhanced health benefits for a user during aerobic exercise. The device of the invention includes an elongated, rigid tube having a hollow interior, and a weighted mass, which is mounted in the hollow interior. The weighted mass is positioned adjacent to one end of the tube and extends throughout a portion of the tube, but does not fill the entire hollow interior.

Also provided according to the invention is a process for fabricating the hand held weighted device by cutting, cleaning and deburring a desired length of steel, forcing the steel into an elongated, rigid tube having a hollow interior, and having a length greater than the length of the steel, placing the tube with the steel into a press and staking the tube and the steel together thereby holding the steel in place, yet without bending or affecting either end of the tube.

The technical advantages of the present invention include a weighted device which provides optimal upper body exercise when used according to the method of the invention. One important aspect is that because the weight is concentrated at one end, a user naturally lifts the loaded end of the weight from the knee height to the shoulder height, a distance two to three times greater than with balanced dumb bell weights positioned in the hands or on the wrist. This repetitive lifting of the weights provides more work and more benefits. When the invention is used during walking, the invention lengthens the user's stride, thereby increasing cardiovascular output or heart rate and providing optimal health benefits. The resulting increased stride will also burn greater calories per hour than walking with conventional hand held weights. Another important aspect of the invention is that the effective weight of the device varies depending on where, along its horizontal axis, a user grasps the device. The invention provides progressive strengthening and exercise benefits to the user. The device provided according to the invention is economical, can be used indoors or out of doors, is portable for travel and is good for all adult ages.

BRIEF DESCRIPTION OF THE DRAWINGS

Other aspects of the invention and their advantages will be discerned when one refers to the following detailed description when taken in conjunction with the drawings, in which.

DETAILED DESCRIPTION OF THE INVENTION

The preferred embodiment of the present invention is best understood by referring to FIGS. 1–6 of the drawings, like numerals being used for like and corresponding parts of the various drawings.

Figure 1:
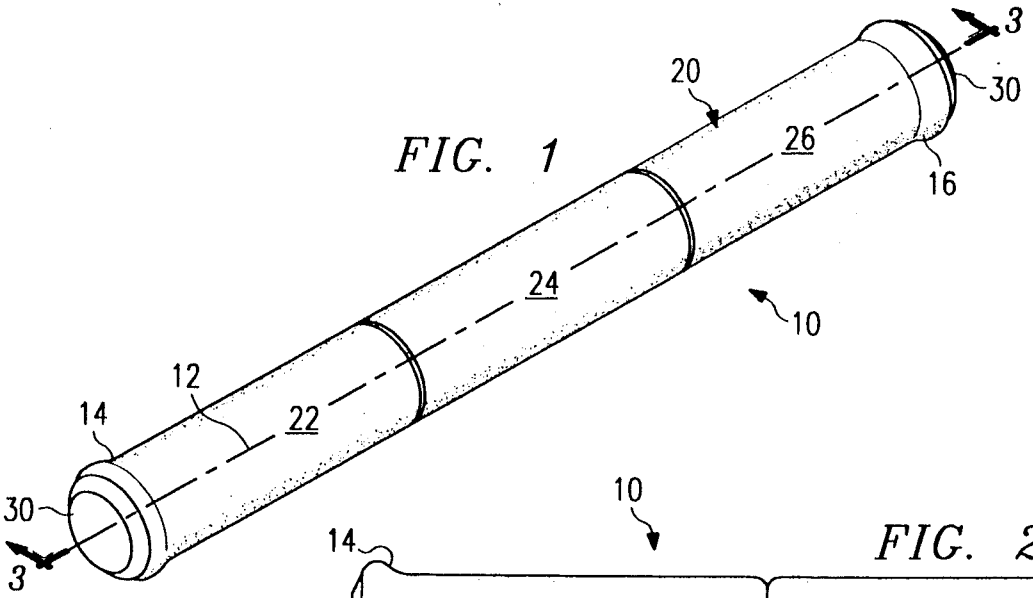
FIG. 1 is a perspective view of the weighted device according to the invention.
Figure 3:
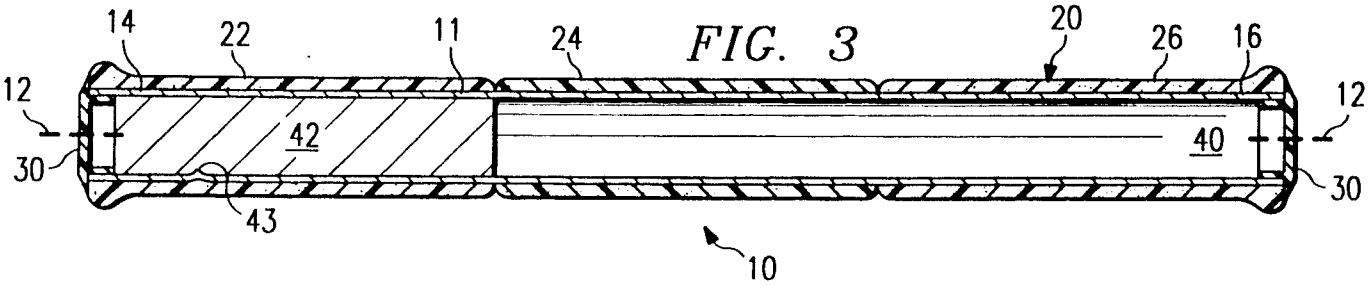
FIG. 3 is a cross-sectional view taken substantially along lines 3—3 of FIG. 1.

As illustrated in FIG. 1, a weighted exercise de vice indicated generally at 10 includes an elongated rigid tube 11 (see FIG. 3). The tube 11 defines a longitudinal axis 12. The device 10 can be used indoors or out of doors, is portable for travel and is good for all adult ages.

Figure 2:
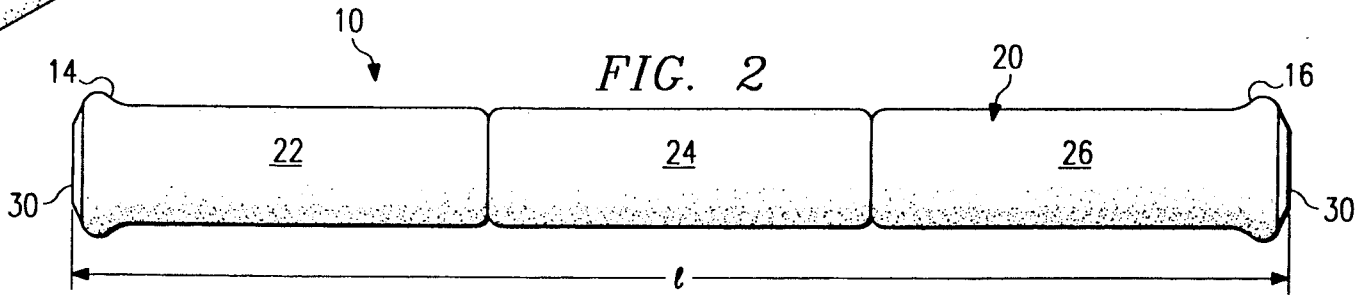
FIG. 2 is an elevational view of the weighted device.

FIG. 2 is an elevational view of the device 10 having length l. Tube 11 has a first end 14 and a second end 16. Tube 11 is covered with resilient material forming coverpiece 20.

The resilient coverpiece 20 is divided into three colored sections 22, 24 and 26 of equal lengths. Grasping device 10 at each section 22, 24 and 26 results in a variation of the effective torque of device 10 relative to the user's hands. Grasping each of the sections, 22, 24 and 26, provide varying strengthening and aerobic benefits to a user. Section 22 is being shown located adjacent to the mass 42 (see FIG. 3). End caps 30 are attached to tube 11 at ends 14 and 16. The caps 30 close the interior of the tube 11 and prevent user contact with the ends 14 and 16.

FIG. 3 is a cross-sectional view taken substantially along lines 3—3 of FIG. 1, illustrating the hollow portion 40 of tube 11 with weighted mass 42 mounted therein, along longitudinal axis 12. Positioning the mass 42 adjacent to the end 14 of the tube 11 produces selected effective torques. The maximum torque is generated when, during upper body exercise, the exercise device 10 is held and lifted (described infra) at a point most remote from the mounted mass 42, which is along colored section 26. Mass 42 may extend throughout not more than 50% of the hollow portion 40. Preferably mass 42 extends throughout not more than 33% of the hollow portion 40.

The elongated tube 11 of device 10 may preferably be made of aluminum. Preferably, tube 11 has a length, l, of approximately 14 inches, having a 0.03125 inch wall thickness and one inch internal diameter. Mounted mass 42 has an outside diameter not less than the inside diameter of tube 11 so that tube 11 is sized to closely receive mass 42. While the mounted mass 42 may include any relatively heavy material, in the preferred embodiment, mass 42 is preferably made of steel and is cut to a length of 3 7/16 inches, cleaned of oils and rust and deburred. The mass 42 is then forced into the tube 11 to a position about ¼" from the first end 14 of tube 11.

The mass 42 may be mounted in the tube 11 by the use of adhesives, but is preferably retained by "staking" the tube 11 to the mass 42. Staking is accomplished by inserting the tube 11 and mass 42 into a press, which has a tool designed to deform the tube 11 and indent mass 42 as shown at 43, thereby retaining mass 42 in place. The tool deforms the tube 11 and mass 44 without bending or affecting either open end of tube 11 A sealant, such as a silicone rubber sealant, is then used as a protectant to help hold mass 42 in place in the event that the staking operation fails in the course of use of the product.

According to the invention, permanently mounting mass 42 within the hollow interior 40 of tube 11 offers the advantages of providing variations in effective torque relative to the user's hands, when the user grasps device 10 at different positions along longitudinal axis 12. These advantages would not be available if mass 42 was allowed to move about hollow interior 40. Additionally, this effect would not be produced if mass 42 extended throughout the hollow interior 40. As previously described, a critical aspect of this invention is that mass 42 extends throughout not more than fifty percent, and preferably not more than thirty-three percent, of the hollow interior 40, effectively abutting one end of tube 11, as described herein.

Tube 11 with mass 42 installed therein is held stationary, while a plurality of pieces of resilient material, preferably three (and, when taken together are referred to as the coverpiece 20), which have been lubricated with alcohol are stripped onto the exterior of the tube 11. The resilient material, or coverpiece 20, is preferably constructed of foam rubber. The coverpiece 20 is divided into at least three distinct sections: 22, 24, and 26, which are each of a different color. The sections 22, 24, and 26 cover the tube 11 forming the device 10. Bonding glue is then applied into the open ends 14 and 16 of tube 11 and end caps 30, preferably made of vinyl, are installed therein.

Figure 4:
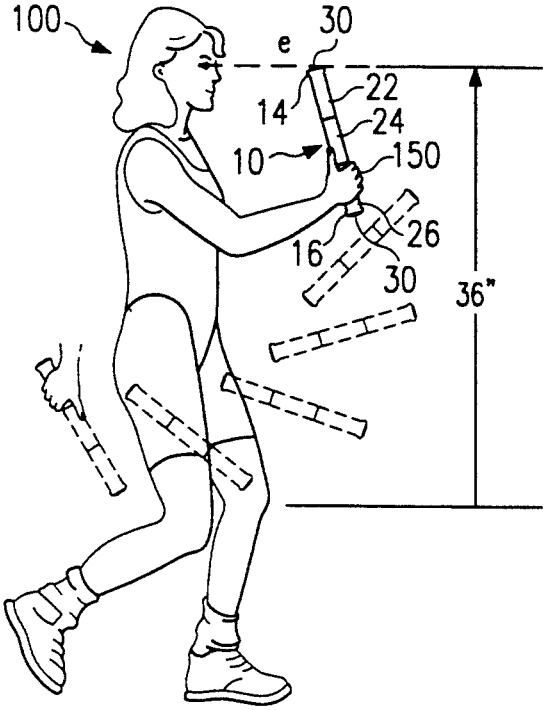
FIG. 4 is a fragmentary perspective view of a person using the weighted device according to one method of the invention.
Figure 5:
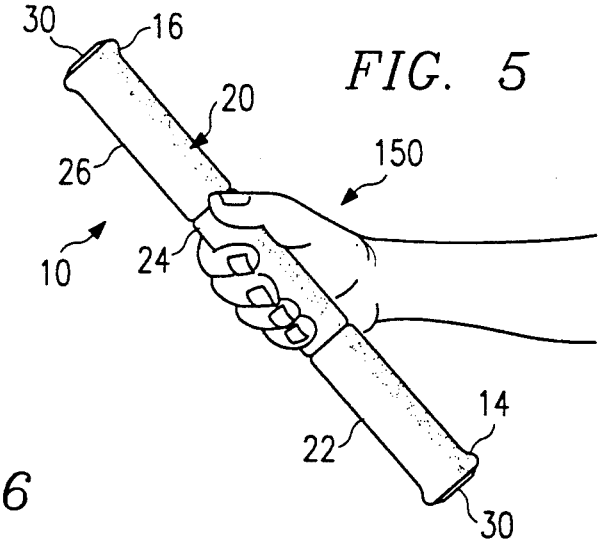
FIG. 5 is a perspective view of a person's hand grasping the weighted device at the center of the device.
Figure 6:
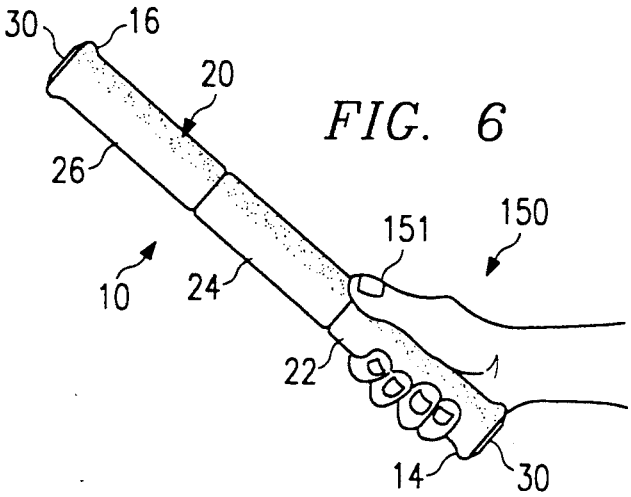
FIG. 6 is a perspective view of a hand grasping the end of the weighted device, whereby the weighted mass is closest to the elbow.

FIGS. 4–6 illustrate the method of using device 10 and describe the variations in grasping positions along longitudinal axis 12 to produce varying effective torques relative to a user's hand. FIG. 4 illustrates a user 100 grasping the device 10 along section 26, which positions the mounted mass 42 at a point most remote from the user's swinging hand 150, preferably at least 10 inches. Walking forward at a natural pace, the user 100 will exhibit a characteristic tendency to lift the loaded end of the weight all the way from the knee height to shoulder height, a much greater distance, in some instances two to three times greater, than the distance covered with conventional weights positioned in the hands or on the wrists.

When held at end 16 by coverpiece section 26 (as illustrated in FIG. 4), according to the preferred embodiment, the effective weight to be lifted is approximately three pounds. Assuming a person takes approximately 1,700 steps per mile with each foot and lifts the weight 36 inches with each arm per swing, the average person thus lifts about 10,000 pounds while walking one mile with the weights. By contrast, balanced weights of the prior art are naturally lifted an average height of 14 inches per step. Consequently, the device 10 according to the invention, when grasped along the coverpiece section 26, provides a lifting distance spanning 2–3 times that of conventional weights.

Tests show that grasping the device 10 when mass 42 is most remote from the lifting arm's fulcrum point (as illustrated in FIG. 4) will lengthen a person's stride by an average of eight percent. This translates into an eight percent increase in walking speed, which results in an eight to ten percent increase in cardiovascular output or heart rate. Not only does this give more aerobic benefit for the heart, but greater cardiovascular work will cause the body to burn approximately ten percent more calories per hour than normal fitness walking.

FIG. 5 illustrates a user's hand 150 grasping device 10 in the middle section 24, which positions the mass 42 closer to the fulcrum point (the arm's elbow) than shown in FIG. 4; consequently providing an effective weight to be lifted of approximately two pounds. This translates into a walker now lifting about 7,000 pounds per mile.

FIG. 6 illustrates a user's hand 150 grasping device 10 at the end 22, which positions the mass 42 closest to the elbow, whereby the mass is easiest to lift, providing an effective weight of approximately one pound. According to the invention, a user grasping end 22 of the device 10 will lift approximately 3,400 pounds per mile.

There are two basic swing styles for fitness walking with device 10. The forward swing grip (illustrated in FIG. 4) strengthens the forearm, biceps, and anterior deltoid muscles. The weight should be swung forward to a height in which the top of the weight comes to the user's eye level, e. Part of the time, the user could concentrate on vigorously punching forward on the upward swing of the weight. At other times, the user can concentrate on vigorously pulling down on the downward swing of the weights. When gripping the weight for this forward swing, the user may find the most comfortable position is with the user's thumb 151 lying in a parallel position to horizontal axis 12 (see FIG. 6) rather than wrapped around device 10. The user may also grip the device using a backward swing such as the grip used for ski poles (not shown). The backward grip especially strengthens the forearm, triceps, latissimus dorsi and posterior deltoid muscles. The effort is very similar to the motion used for cross-country skiing. As the user vigorously pushes downward and backward with each swing, the user could possibly imagine pushing through the snow on skis. The user will feel tension in the triceps at the back of the upper arms as device 10 is thrust backward.

A user should first use the device 10 during a fitness walk holding device 10 at section 22 as shown in FIG. 6. Holding device 10 in this light-weight zone lets the user develop a feel for swinging the newly weighted and "extended arms" in cadence with the user's stride. The user should learn to relax the grip during the downward phase of each starting cycle. This relaxation keeps the user's fingers and forearms from tiring too early, enabling the user to exercise longer. As a user's arm muscles tire, the user may change the grip from the forward swing to the backward swing, or vice versa, those swings described supra. Changing grip shifts the lifting load from the biceps to the triceps. Additionally and for variety, a user can try lifting the weight in an accentuated curling fashion rather than swinging them farther in front. In a curling fashion, the user allows the arms to cross over in front of the chest area. This emphasizes the bicep muscles and is easier to do at a slightly slower pace during fitness walking.

Ideally a user should work out four to five times per week, 30 to 60 minutes at a time for the utmost in aerobic, strengthening and cardiovascular benefits. When walking for fitness the user should concentrate on walking rapidly. The user should try to walk three to four miles at a pace of at least one mile in 15 minutes. Walking more slowly than a mile in 20 minutes does not provide for optimal fitness.

The use of the weighted device 10 may be coordinated with various aerobic exercises as desired by the user. The weighted device 10 may be used during walking, using a forward grip or a backward grip or to add arm work to an exercise bicycle. It has been found that the repetitive lifting of the device 10 increases cardiovascular output or heart rate and burns more calories per hour than exercise without the weighted device 10. The weighted device 10 provides substantial improvement and muscle tone, weight control and overall body conditioning to provide improved physical fitness of the user in a simple, safe and economical manner.

Device 10 is also ideal for disabled and older persons to use while sitting in a chair or a wheelchair, because of the variable work load and increased rate of motion. Device 10 is easily transportable and can fit easily into any suitcase or bag and can be used aerobically with music, virtually anywhere.

While the preferred embodiment of the invention and their advantages have been set forth in the above detailed description, the invention is not limited thereto but only by the scope and spirit of the appended claims.

What is claimed is:

1. A hand-held weighted device comprising:

a single rigid tube having a first end, a second end, an exterior surface, and a hollow interior;

said tube having a length sufficient for at least three non-overlapping, contiguous grip sections;

a solid weight fixedly mounted in said hollow interior and adjacent to said first end of said tube;

said weight disposed in only a portion of said length of said hollow interior of said tube;

a resilient coating suitable for gripping disposed on all portions of said exterior surface;

said coating defining a first protrusion at said first end, a second protrusion at said second end, and said grip sections;

said grip sections having a grip surface which is free of protrusions and of a substantially uniform diameter;

said grip surface extending from said first protrusion to said second protrusion; and wherein said grip sections are of substantially equal lengths.

2. The device of claim 1, wherein said tube is cylindrical in shape.

3. The device of claim 1, wherein said tube comprises aluminum.

4. The device of claim 1, wherein said weight comprises steel.

5. The device of claim 1, wherein said weight extends throughout not more than 50% of said hollow interior.

6. The device of claim 5, wherein said weight extends throughout not more than 33% of said hollow interior.

7. The device of claim 1, wherein said resilient coating comprises foam rubber.

8. The device of claim 1, wherein said at least three non-overlapping, contiguous grip sections each have a different color for identification of effective torque.

9. The device of claim 1, wherein said weight is retained in said hollow interior by an adhesive.

10. The device of claim 9, wherein said adhesive comprises a silicone rubber sealant.

11. The device of claim 1, wherein said interior of said tube has an inside diameter sized to closely receive said weight.

12. The device of claim 1, including an end cap located on each of said first and second ends of said rigid tube.

* * * * *